US005125851A

United States Patent [19]

Peterson et al.

[11] Patent Number: 5,125,851

[45] Date of Patent: Jun. 30, 1992

[54] INSULATION DISPLACEMENT TERMINAL FOR AN ELECTRICAL CONNECTOR

[75] Inventors: Bruce A. Peterson, Schaumburg; James T. Roberts, Oak Park, both of Ill.

[73] Assignee: Molex Incorporated, Lisle, Ill.

[21] Appl. No.: 763,839

[22] Filed: Sep. 23, 1991

[51] Int. Cl.[5] ..... H01R 4/24

[52] U.S. Cl. ..... 439/421; 439/424

[58] Field of Search ..... 439/395-407, 439/421-424, 427, 391, 394

[56] References Cited

U.S. PATENT DOCUMENTS

| | | | |
|---|---|---|---|
| 4,191,442 | 3/1980 | Caveny et al. | 439/421 |
| 4,512,619 | 4/1985 | Dichelette | 439/427 |
| 4,522,460 | 6/1985 | Beck, Jr. et al. | 439/421 |
| 4,955,816 | 9/1990 | Roberts et al. | 439/421 |

*Primary Examiner*—David L. Pirlot
*Attorney, Agent, or Firm*—Stephen Z. Weiss

[57] ABSTRACT

A collapsible insulation displacement terminal is disclosed for terminating an insulated wire having an electrical conductor with a sheath of insulation thereabout. The terminal includes at least one terminal wall portion deflectable for displacing the insulation and for engagement with the conductor upon application of a force on the terminal in a direction generally parallel to the longitudinal axis of the insulated wire. The first terminal wall portion includes a blade portion deformable therefrom generally parallel to the axis of the insulated wire to present a substantial area of contact with the conductor of the wire. A second terminal wall portion is deflectable upon application of the axial force into engagement with the blade portion of the first terminal wall portion to insure contact between the electrical conductor and the first terminal wall portion.

17 Claims, 2 Drawing Sheets

INSULATION DISPLACEMENT TERMINAL FOR AN ELECTRICAL CONNECTOR

FIELD OF THE INVENTION

This invention generally relates to the art of electrical connectors and, particularly to a terminal for insulation displacement terminating an electrical cable or wire.

BACKGROUND OF THE INVENTION

Electrical connectors have become widely accepted as a preferred means for interconnecting the circuitry components of electrically operated products and equipment. In such applications, providing for the facile connection and disconnection of cable or wire through the use of connectors permits convenience of assembly and maintenance as well as versatility in design.

Connectors in current use are of diverse construction. However, a common arrangement includes a dielectric housing fitted with a plurality of stamped and formed conductive terminals to which insulated multiconductor cable or wiring may be electrically connected. Numerous terminal configurations likewise are available, suited to the specific requirement of the application. A preferred terminal in many applications is one which has the capability of establishing electrical contact with the conductors of the cable by displacement of the insulative coating of the conductors, obviating the need to perform the separate step of stripping the insulative coating.

A wide variety of insulation displacement terminals are known in the art. Generally, these terminals provide a narrow slot which receives an insulation covered wire, severs the insulation covering of the wire in the process, and establishes, automatically, an electrical connection between the terminal and the central core of the wire. This is contrasted with the self-piercing type of terminals which usually have sections in the form of teeth that pierce the insulation and enter the metallic core when the terminal is clinched or secured to the wire.

Both the self-piercing and insulation displacement terminals, as previously known in the art, suffer from a number of disadvantages. First, both techniques have limitations in terms of the acceptable wire dimensions which may be used in connection with a specific terminal. In addition, many terminals generally require a transverse actuating force to be applied in order to establish the electrical connection. That is, a force must be applied transversely of the length of the wire, requiring the wire to be accessible to the transversely applied force at the terminal. Where it is desired that the terminals are prefitted into the connector housing prior to wire termination, the requirement of transverse terminal accessibility prevents the close spacing of a plurality of connections. This condition is particularly limiting where multiple rows of circuit connections are desired.

The above problems have been solved by very effective prior art terminals shown in U.S. Pat. Nos. 4,512,619 to Dechelette, dated Apr. 23, 1985, and 4,955,816 to Roberts et al., dated Sep. 11, 1990, both of which are assigned to the assignee of this invention and which are incorporated herein by reference. Briefly, those patents show novel terminals wherein collapsible conductor engaging portions are collapsed inwardly to displace the insulation of an insulated wire and establish conductivity with the core of the wire upon the application of forces on the terminal in a direction generally parallel to the longitudinal axis of the terminated insulated wire. This invention is directed to further improvements in such unique terminals.

Specifically, electrical connectors utilizing insulation displacement terminals of the character described above have been miniaturized drastically in recent years to conform with the corresponding miniaturization of circuits and electrical components. Despite the smaller dimensions, it is necessary for connectors to consistently provide high quality electrical connections. Even small improvements in performance have become very significant in the electronics industry. With the invention herein, collapsible portions of the terminal not only displace the insulation of the insulated wire to establish conductivity with the conductive core of the wire, but the collapsible portions of the terminals provide increased contact areas with the conductive core. In addition, strain relief is provided for the collapsible portions of the terminals, all in response to collapsing the terminal by the application of a force on the terminal in a direction generally parallel to the longitudinal axis of the insulated wire.

SUMMARY OF THE INVENTION

An object, therefore, of the invention is to provide a new and improved terminal which enables an electrical connection to be established with an insulated wire upon the application of an axial force directed generally parallel to the longitudinal axis of the wire.

In the exemplary embodiment of the invention, a collapsible insulation displacement terminal is disclosed for terminating an insulated wire having an electrical conductor with a sheath of insulation thereabout. The terminal includes a first terminal wall portion deflectable for displacing the insulation of the wire into engagement with the conductor of the wire upon the application of the axial force. A second terminal wall portion is deflectable, upon the application of the axial force, into engagement with the first terminal wall portion to provide strain relief therefor and to force a larger portion of the first terminal wall to contact the electrical conductor of the wire.

More specifically, the first terminal wall portion includes a blade portion deformable generally parallel to the axis of the insulated wire whereby the blade portion presents a substantial area of contact with the conductor of the wire. The blade portion includes an insulation displacing edge. The second terminal wall portion includes an abutting edge for engaging the blade portion.

As disclosed herein, the terminal includes at least one side wall from which the first and second wall portions are deflectable. The side wall includes weakened areas to facilitate deflection of the wall portions. The side wall has aperture means. The insulation displacement edge of the first wall portion and the abutting edge of the second wall portion are defined by edges of the aperture means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
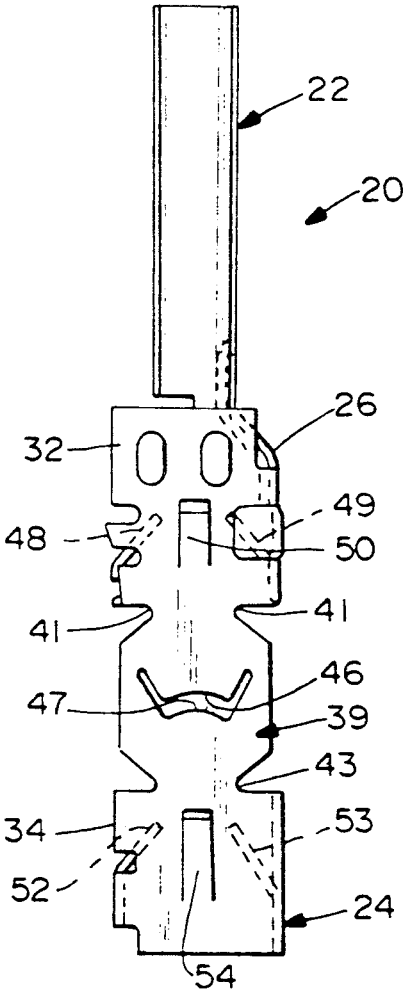
FIG. 1 is a side elevational view of an insulation displacement terminal according to the invention.

The pin terminal of the subject invention is identified generally by the numeral 20 in FIGS. 1-4. The terminal is stamped and formed from a unitary piece of metallic material, and preferably a copper base alloy. The terminal includes a forward generally cylindrical mating end 22, a rear wire receiving end 24 and an intermediate nonplanar gusseted transition area 26 extending therebetween. Mating end 22 is characterized by a longitudinally extending slit 28.

The rear wire receiving end 24 of the pin terminal 20 is of generally rectangular box-shaped cross-sectional configuration and includes a forward wire receiving portion 32, a rearward wire receiving portion 34 and an intermediate collapsible contact section 36. The contact section 36 is defined by a pair of opposed collapsible contact walls, generally designated 38 and 39, which are pre-formed in inward directions to ensure inward collapsing in response to axial forces exerted on the wire receiving end. The inward collapsing is facilitated by the reduced width portions 40 and 42 on the opposed ends of the collapsible wall 38 and the reduced width portions 41 and 43 to provide weakened areas on the opposed ends of the collapsible wall 39. The collapsible walls 38 and 39 are further characterized by polygonal or W-shaped apertures 44. The forward edge 46 of each aperture 44 is configured to displace the insulation on the wire inserted into the terminal 20, and the rearward edge 47 provides an abutting edge, for purposes described hereinafter.

Figure 2:
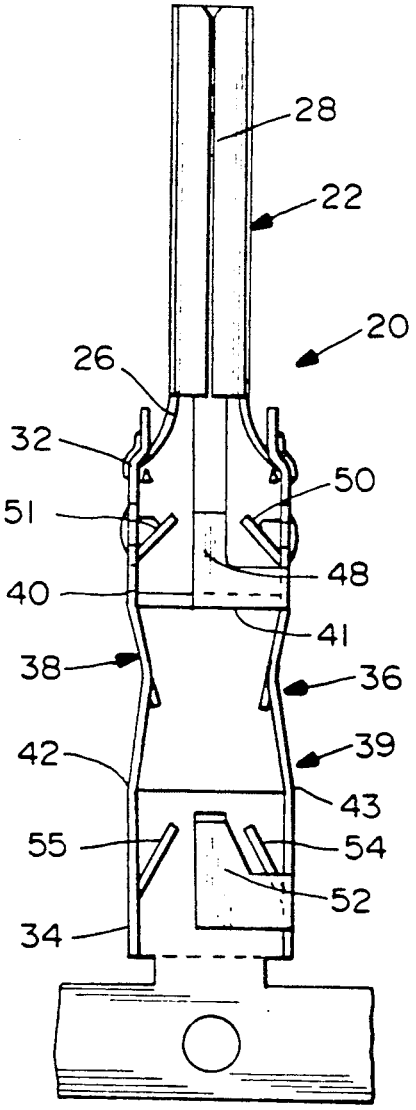
FIG. 2 is a top plan view of the terminal shown in FIG. 1.
Figure 3:
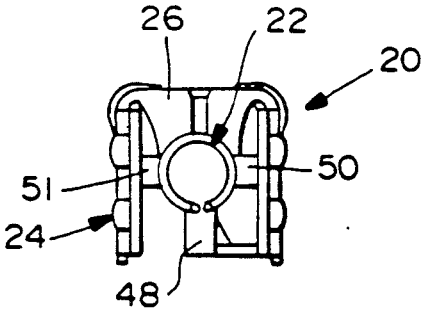
FIG. 3 is an end view of the mating end of the terminal.
Figure 4:
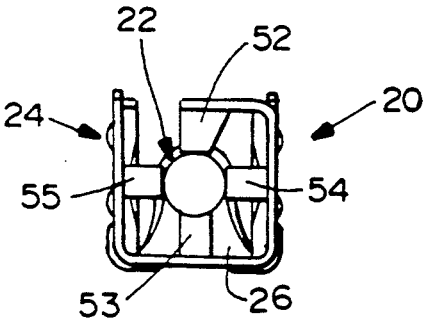
FIG. 4 is an end view of the terminal opposite that of FIG. 3.

As shown most clearly in FIG. 2, terminal 20 does not include transverse walls in the longitudinal section defining the collapsible contact section 36 thereof. Rather, the generally rectangular front wire receiving portion 32 and the generally rectangular rear wire receiving portion 34 are connected only by the two spaced apart collapsible walls 38 and 39 defining the collapsible contact section. In view of this construction, axial forces exerted on the opposed ends of the wire receiving portion 24 of the terminal 20 will cause an inward collapsing of the inwardly formed walls 38 and 39. As explained in greater detail in U.S. Pat. No. 4,512,619, the inward collapsing is carefully controlled and located to define pivoting about the reduced width sections 41 and 43, and further to define pivoting about a line 64 extending transversely through the apertures 44. The inward collapsing caused by the axial forces exerted on the wire receiving end 24 of terminal 20 will cause the edge 46 to pierce through and displace the insulation on the wire to achieve electrical connection with the conductors therein. The configuration and dimensions of the edge 46 of aperture 44 is selected to ensure high quality contact with the conductors in the wire.

Strain relief of the electrical connectors is essential to prevent rearward forces on a wire from affecting the quality of the electrical connection between the wire and the terminal. In the subject connector system which provides mass terminatable insulation displacement terminals, it also is desirable to ensure that the wires are fully seated prior to termination and are not inadvertently withdrawn in the interim, between the full seating and the mass termination. To ensure secure seating of the wire prior to termination and to provide the necessary strain relief, the subject terminal 20 is provided with forward and rearward arrays of resilient cantilevered fingers. In particular, a total of four forward fingers 48-51 are cantilevered to extend inwardly and forwardly from the forward end 32 of the wire engaging portion 24 of terminal 20. The length and angular alignment of the forward fingers 48-51 initially prevents deflection and associated forward movement of the wire into the wire receiving portion 24. Thus, the forward fingers function as wire stops which initially control the depth of wire insertion. The wire will be urged past the forward fingers during termination, at which time the forward fingers will contribute to strain relief. Four rearward fingers 52-55 are cantilevered from the rearward portion 34 of the wire receiving end 24 of terminal 20 and are separated by about 90°. The rearward fingers also are cantilevered to extend forwardly and into the wire receiving portion 24. The rearward fingers are aligned at a smaller angle to the side wall and readily deflect in response to the forward insertion of the wire into the terminal 20. Thus, the rearward fingers will grippingly engage the insulation on the wire to prevent rearward withdrawal of the wire both prior to and subsequent to termination. The provision of two axially spaced sets of fingers with the fingers in each set being spaced by 90° ensures proper axial positioning of the wire an exceptional strain relief both before and after termination.

The gusset wall 26 of the terminal 20 is of nonplanar tapered shape and defines a transition from the relatively large rectangular cross sectioned wire receiving portion 24 to the relatively small circular cross sectioned mating end 22. The gusset wall 26 begins rearwardly of the forward-most end of the wire receiving portion, and extends arcuately into a generally cylindrical arch of at least approximately 90°. The transition in the gusset wall 26 from the generally planar rectilinear wall of wire receiving end 24 into the arcuate configuration adjacent mating end 22 provides for a rigid interconnection between the mating end and the wire receiving end. The strength and rigidity of the interconnection is further enhanced by an inwardly extending embossment 56 extending the entire length of gusset wall 26 and partly into both mating end 22 and wire receiving end 24. The gusset wall achieves the reduction in cross-sectional dimension between the wire receiving end and the mating end.

Figure 5:
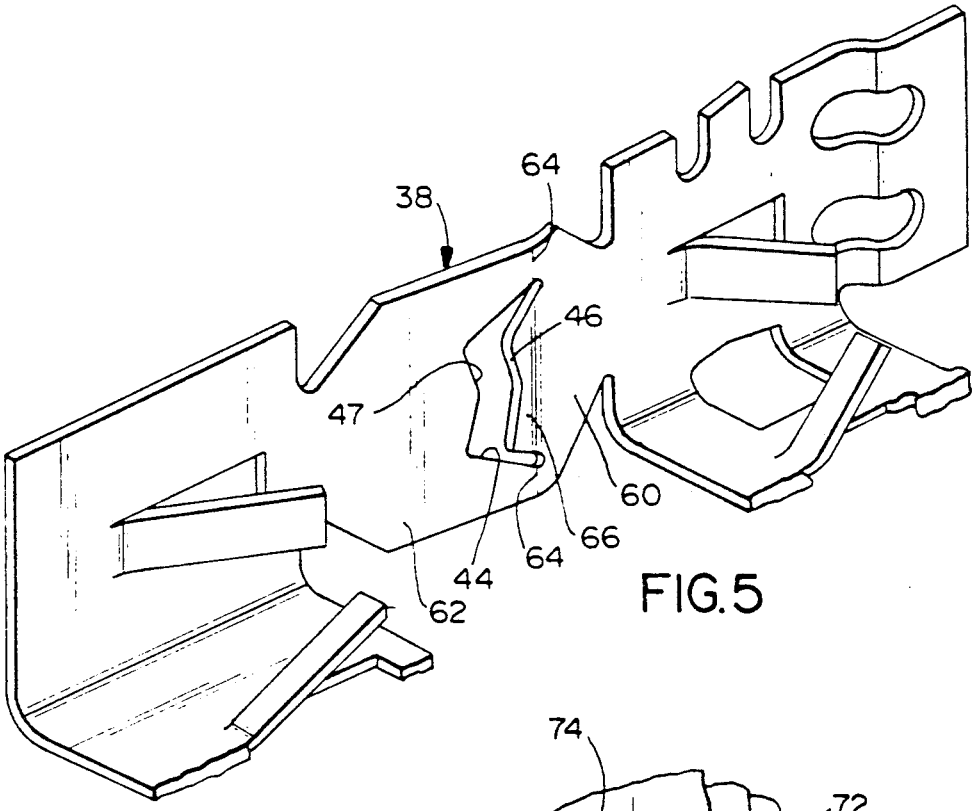
FIG. 5 is a fragmented perspective view, on an enlarged scale, of the terminal, to better illustrate the deflectable wall portions thereof.
Figure 6:
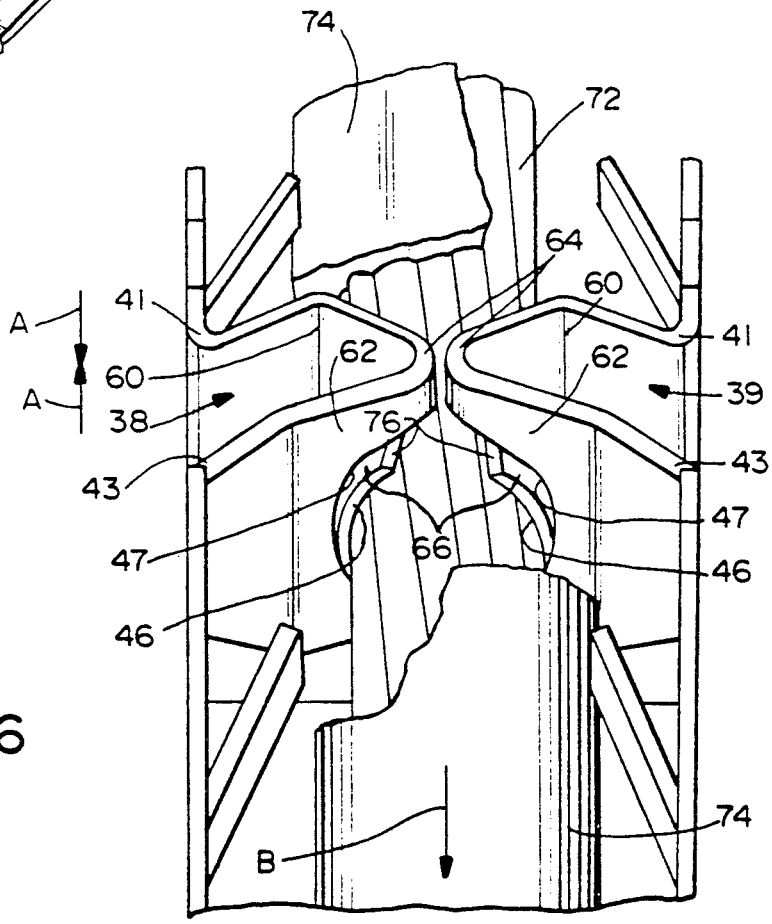
FIG. 6 is a fragmented perspective view of the terminal terminated to a stranded conductor of an insulated wire.

Referring to FIGS. 5 and 6 in conjunction with previously described FIGS. 1-4, the deformation and deflection of contact walls 38 and 39 to displace the insulation of an insulated wire and establish conductivity with the conductive core of the wire now will be described.

Referring first to FIG. 5, collapsible contact wall 38 is illustrated, and the following description thereof and in regard thereto is equally applicable for contact wall 39. In addition, although the terminal displaces the insulation of an insulated wire to establish contact with the conductive core of the wire, most of the insulation has been removed from the depiction in FIG. 6 so that the end deformation of the contact walls can be seen. Otherwise, showing the displaced insulation would obscure some of the critical areas of the collapsed contact walls.

More particularly, referring first to FIG. 5, each collapsible contact wall 38 and 39 includes a first terminal wall portion 60 and a second terminal wall portion 62, both of which are deflectable inwardly upon application of forces on the terminal in a direction generally parallel to the longitudinal axis of the insulated wire, as described below in relation to FIG. 6. As will be seen, first and second terminal wall portions 60 and 62, respectively, bend relative to each other along a line indicated by dotted line 64 in FIG. 5.

FIG. 5 also shows that polygonal apertures 44 are generally W-shaped to define insulation displacement edge 46 of first wall portion 60 and abutting edge 47 of second wall portion 62. The application of an axial force will cause first terminal wall portion 60, which includes a blade portion 66, to bend (as will be seen in FIG. 6) generally along a line coincident with bend line 64 and reduced width portion 41 and second terminal wall portion 62 to bend about bend line 64 and reduced width portion 43. This will cause aperture forward edge 46 to penetrate the insulation. Additional axial force will cause blade portion 66 to bend and abutting edge 47 to contact wall portion 60 to force its surface to lie in contact with electric conductor core 72 to provide a substantial area of contact between wall portion 60 and the conductor core 72 of the insulated wire.

Referring to FIG. 6 in conjunction with FIG. 5, an insulated wire, generally designated 70, is shown to include an electrical conductor core 72 surrounded by an insulating sheath 74. The conductor core is shown as a round stranded conductor, but it must be understood that the basic principles of the invention are equally applicable to a solid conductor core as well as a non-round conductor core.

FIG. 6 shows that collapsible contact walls 38 and 39 have been collapsed inwardly toward each other to substantially embrace conductor core 72 of the insulated wire. It can be seen that the contact walls have become bent inwardly about the weakened areas provided by reduced width portions 41 and 43. In addition, it can be seen that first and second terminal wall portions 60 and 62 of collapsible contact walls 38 and 39 have become bent relative to each other at bend lines 64. Still further, it can be seen that blade portions 66 of first terminal wall portions 60 have become bent out of the first terminal wall portions generally parallel to the axis of the insulated wire to present substantial areas 76 of the contact with conductor core 72. Lastly, it can be seen that abutting edges 47 of second wall portions 62 have engaged blade portions 66 to maintain the contact between first terminal wall portion 60 and the conductor core 72.

In operation, upon the application of relatively axial forces in the direction of arrows "A" (FIG. 6), collapsible contact walls 38 and 39 will deflect inwardly and deform as shown in the depiction and as described above. However, during the actual deflection and deformation, a sequence of events occurs. First, insulation displacement edges 46 of blade portions 66 of first terminal wall portions 60 will cut into insulation 74 of insulated wire 70 until the edges engage the more solid structure of conductor core 72. As the axial forces continue, blade portions 66 start bending and move axially along the outside surface of conductor core 72 in the direction of arrow "B". The blades will bend to the position shown in FIG. 6 whereby the inside surfaces of the blade portions provide the substantial areas 76 of contact with the conductor core. As the blade portions 66 continue bending, edges 47 of second terminal wall portions 62 abut against the outside surfaces of blade portions 66 to force a larger portion of the outside surfaces of blade portions 66 into contact with conductor core 72 and to maintain the contact therebetween.

In its final deflected and deformed configuration as shown in FIG. 6 and described above, it can be understood how the terminal of the invention has significant advantages, particularly in miniaturized stamped and formed sheet metal terminals. Increased surface area contact with the conductor core of the insulated wire is effected by the terminal of the invention versus the construction of the prior art. In addition, built-in strain relief is provided for the conductor engaging portions of the terminal. These advantages are afforded automatically in response to the application of the axial forces on the terminal generally parallel to the axis of the insulated wire.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A collapsible insulation displacement terminal for terminating an insulated wire having an electrical conductor with a sheath of insulation thereabout, comprising at least one first terminal wall portion deflectable for displacing the insulation and for engagement with the conductor upon application of a force on the terminal in a direction generally parallel to the longitudinal axis of the insulated wire, and a second terminal wall portion deflectable upon application of said force into engagement with said first terminal wall portion to insure contact between the electrical conductor and the first terminal wall portion.

2. The collapsible insulation displacement terminal of claim 1, including a side wall from which said first and second wall portions are deflectable, and the side wall includes weakened areas to facilitate deflection of the wall portions.

3. The collapsible insulation displacement terminal of claim 1 wherein said first terminal wall portion includes an insulation displacing edge.

4. The collapsible insulation displacement terminal of claim 1, including a side wall having aperture means, and said second terminal wall portion includes an abutting edge for engaging the first terminal wall portion to insure contact between the electrical conductor and the first terminal wall portion, the abutting edge being defined by an edge of the aperture means.

5. The collapsible insulation displacement terminal of claim 1 wherein said first terminal wall portion includes a blade portion deformable therefrom in a position generally parallel to the axis of the insulated wire whereby the first terminal wall portion presents a substantial area of contact with the conductor of the wire.

6. The collapsible insulation displacement terminal of claim 5 wherein said first terminal wall portion includes an insulation displacing edge.

7. The collapsible insulation displacement terminal of claim 1, including a side wall having aperture means, and said first terminal wall portion includes an insulation displacing edge defined by an edge of the aperture means.

8. The collapsible insulation displacement terminal of claim 7 wherein said second terminal wall portion includes an abutting edge for engaging the first terminal wall portion to insure contact between the electrical conductor and the first terminal wall portion, the abutting edge being defined by an edge of the aperture means.

9. A collapsible insulation displacement terminal for terminating an insulated wire having an electrical conductor with a sheath of insulation thereabout, comprising a body positionable about an insulated wire, the body being generally U-shaped in cross-section and including a pair of weakened generally opposed side walls, each side wall including at least one first terminal wall portion deflectable for displacing the insulation and for engagement with the conductor upon application of a force on the terminal in a direction generally parallel to the longitudinal axis of the insulated wire, and a second terminal wall portion deflectable upon application of said force into engagement with said first terminal wall portion to insure contact between the electrical conductor and the first terminal wall portion.

10 The collapsible insulation displacement terminal of claim 9 wherein each side wall includes weakened areas to facilitate deflection of the wall portions.

11. The collapsible insulation displacement terminal of claim 9 wherein said first terminal wall portion includes an insulation displacing edge.

12. The collapsible insulation displacement terminal of claim 9 wherein each side wall has aperture means, and said second terminal wall portion includes an abutting edge for engaging the first terminal wall portion to insure contact between the electrical conductor and the first terminal wall portion, the abutting edge being defined by an edge of the aperture means.

13. The collapsible insulation displacement terminal of claim 9 wherein said first terminal wall portion includes a blade portion deformable therefrom generally parallel to the axis of the insulated wire whereby the first terminal wall portion presents a substantial area of contact with the conductor of the wire.

14. The collapsible insulation displacement terminal of claim 13 wherein said first terminal wall portion includes an insulation displacing edge.

15. The collapsible insulation displacement terminal of claim 9 wherein each side wall has aperture means, and said first terminal wall portion includes an insulation displacing edge defined by an edge of the aperture means.

16. The collapsible insulation displacement terminal of claim 15 wherein said second terminal wall portion includes an abutting edge for engaging the first terminal wall portion to insure contact between the first electrical conductor and the first terminal wall portion, the abutting edge being defined by an edge of the aperture means.

17. A collapsible insulation displacement terminal for terminating an insulated wire having an electrical conductor with a sheath of insulation thereabout, comprising at least one side wall having an aperture, a first terminal wall portion and a second terminal wall portion, the first terminal wall portion being deflectable for displacing the insulation and for engagement with the conductor upon application of a force on the terminal in a direction generally parallel to the longitudinal axis of the insulated wire, the first terminal wall portion including a blade portion deformable therefrom generally parallel to the axis of the insulated wire whereby the terminal wall portion presents a substantial area of contact with the conductor, the terminal wall portion including an insulation displacement edge defined by an edge of said aperture, the second terminal wall portion being deflectable upon application of said force into engagement with said first terminal wall portion to insure contact between the electrical conductor and the first terminal wall portion, the second terminal portion including an abutting edge for engaging the blade portion, and the abutting edge being defined by an edge of said aperture.

* * * * *